US005177987A

United States Patent [19]

Shen

[11] Patent Number: 5,177,987

[45] Date of Patent: Jan. 12, 1993

[54] KEY-IN-LEVER TYPE DOOR LOCK USED FOR HANDICAPPED PEOPLE

[76] Inventor: Chao C. Shen, No. 62, Hoshan St., Tainan, Taiwan

[21] Appl. No.: 729,371

[22] Filed: Jul. 12, 1991

[51] Int. Cl.[5] ..... E05B 13/10

[52] U.S. Cl. ..... 70/224; 70/479; 292/336.3; 292/336.5

[58] Field of Search ..... 70/224; 292/336.3, 336.5, 292/471, 475, 479, 489

[56] References Cited

U.S. PATENT DOCUMENTS

| | | | |
|---|---|---|---|
| 1,876,576 | 9/1932 | Arste | 70/479 |
| 2,726,891 | 12/1955 | Gresham et al. | 70/224 |
| 3,354,676 | 11/1967 | Wilson | 70/479 |
| 4,031,725 | 6/1977 | Reid | 70/107 |
| 4,594,864 | 6/1986 | Hart | 70/476 |
| 4,604,879 | 8/1986 | Neary et al. | 70/224 |
| 4,838,053 | 6/1989 | Shen | 292/336.3 |
| 4,945,737 | 8/1990 | Hart | 70/489 |

*Primary Examiner*—Renee S. Luebke
*Assistant Examiner*—D. Boucher
*Attorney, Agent, or Firm*—Morton J. Rosenberg; David I. Klein

[57] ABSTRACT

A key-in-lever type door lock which can be installed on either a left hand or right hand door by a left-right reverse operation of a reverse plate. The lock comprises a lock assembly which regulates a uni-directional, 45-degree rotation of a handle thereof and a latch assembly which converts the 45-degree rotational movement to a retraction of a latch bolt. The lock is jimmy-proof, i.e., secure against improper manipulation, by the provision of a latch stop pivoted to the latch bolt and being movable together therewith. The latch stop, which has a catch end normally blocked by a retaining plate, is operationally pivotable about the latch bolt to release the blockage, thereby permitting a relative sliding movement between the latch stop and the retaining plate.

7 Claims, 10 Drawing Sheets

KEY-IN-LEVER TYPE DOOR LOCK USED FOR HANDICAPPED PEOPLE

BACKGROUND OF THE INVENTION

This invention relates to a key-in-lever type door lock, particularly a door lock used by handicapped people who generally have a limited use of their hands, thereby experiencing difficulty when turning a knob type door lock.

Because of the mechanism, a customary key-in-lever type door lock can only be installed in either a left hand or a right hand door, not both, as well as the handle of the lock must be turned about 90 degrees in order to open the door. There exist some inconveniences in installing a conventional lever door lock in a door, because the installer must make sure whether the lock is to be installed in a left hand or a right hand door before installation. Also, the conventional lever door lock is not ergonomically designed for handicapped people, since the handle of the lock must be rotated about 90 degrees to open the door. To overcome the disadvantages of the conventional key-in-lever type door locks, the present invention discloses a lever door lock which can be installed in a door whether it is left handing or right handing. Also, by turning the handle of the present invention only about 45 degrees, the door can be opened, thereby being more accessible for handicapped people. In addition to the advantages mentioned above, the invention further has the feature of security against improper manipulation, i.e., being jimmy-proof.

It is the purpose of this present invention, therefore, to mitigate and/or obviate the above-mentioned drawbacks in the manner set forth in the detailed description of the preferred embodiment.

SUMMARY OF THE INVENTION

It is an object of the present invention to provide a key-in-lever type door lock which can be installed in a right hand or left hand door.

It is another object of the present invention to provide a key-in-lever type door lock wherein, by only turning the handle of the lock about 45 degrees, the door can be opened.

It is still another object of the present invention to provide a key-in-lever type lock with a feature of security against improper operation, i.e., being jimmy-proof.

These and additional objects, if not set forth specifically herein, will be readily apparent to those skilled in the art from the detailed description provided hereunder, with appropriate reference to the accompanying drawing.

DETAILED DESCRIPTION OF THE PREFERRED EMBODIMENT

Figure 1:
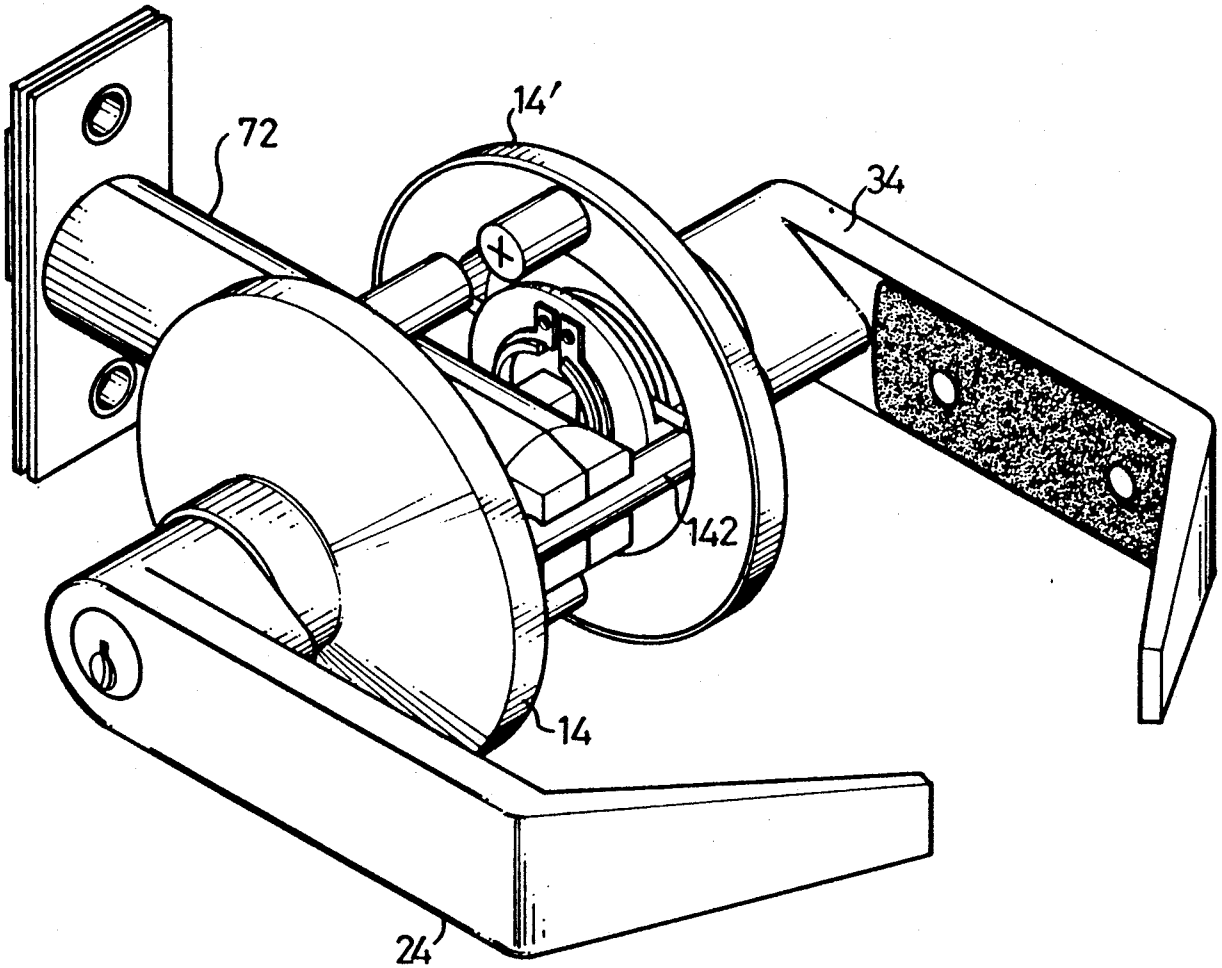
FIG. 1 is a perspective view of a key-in-lever type door lock, including an outer portion and an inner portion of a lock assembly and a latch assembly, in accordance with the present invention.

Referring to the drawings, and particularly to FIG. 1, the present invention includes an outer portion and an inner door portion of a lock assembly and a latch assembly. The outer portion of the lock assembly includes an outside lever handle 24 and an escutcheon 14 with a pair of mounting screw posts 142. The inner portion of the lock assembly includes an inside lever handle 34 and an escutcheon 14'. The latch assembly includes a latch housing 72. By turning either of the handles 24 and 34, a bolt located within the latch housing will perform a linear movement relative to the latch housing.

Figure 2:
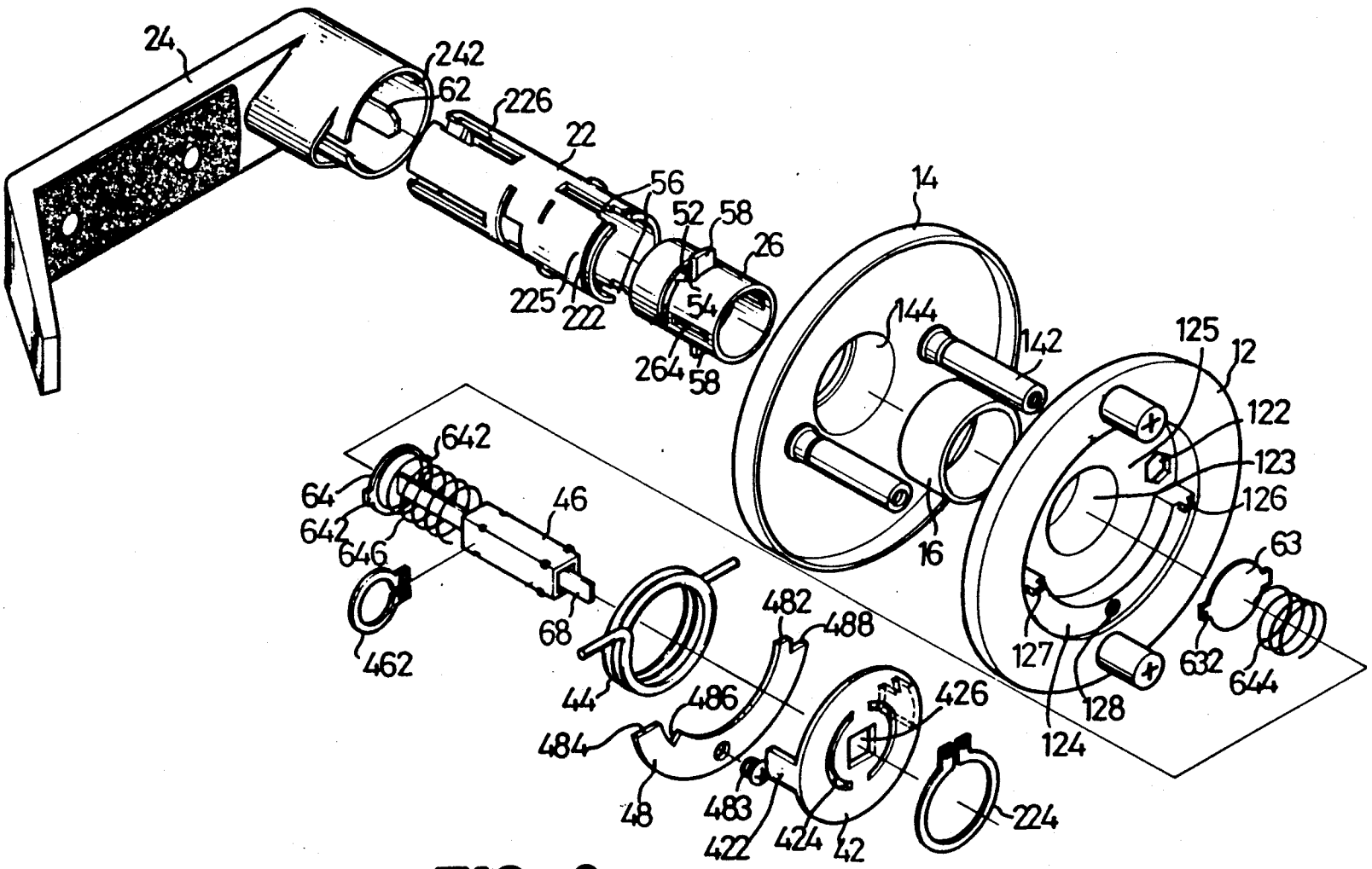
FIG. 2 is an exploded view of the outer portion of the lock assembly.

Referring to FIG. 2, the outer portion of the lock assembly comprises: a first mounting means which includes the escutcheon 14 with the pair of mounting screw posts 142, a first mounting plate 12, and a spacer 16; a first driving means which includes the outside lever handle 24, an outside spindle 22, and a locking plug 26; a driven means which includes a spring 646, a square spindle 46, a retractor spring 44, a reverse plate 48, a retractor 42, a spindle retainer ring 462, and a spindle retainer 224; a control means which includes a pair of annular slots 52 (only one can be seen) formed on the locking plug 26 each having an indented edge 54, a locking slide 58 attached to a round plate inside the locking plug 26, a pair of notches 56 diametrically formed on an end of the outside spindle 22, and a pair of grooves 57 diametrically formed on a boss 121 (see FIG. 8) of the mounting plate 12; and a locking means which includes a cylinder bar 62 located within the outside lever handle 24, a spring seat 63 with two extrusions 632, a plunger retainer 64 with two extrusions 642 in its periphery, a plunger bar 68 connected with the plunger retainer 64, and other parts located on the inner portion of the lock assembly.

Still referring to the FIG. 2, to assemble the outer portion of the lock assembly, firstly, assemble the locking means by inserting the spring seat 63 into the locking plug 26, fitting the two extrusions 642 thereof into a pair of slots 264 of the locking plug 26; then, abut a spring 644 against the spring seat 63 and insert the plunger retainer 64 with the plunger bar 68 into the locking plug 26, fitting the two extrusions 642 thereof into the slots 264. The spring force of the spring 644 urges the spring seat 63 and the plunger retainer 64 to be at distal ends of the slots 264, respectively. After this, the first driving means is assembled by inserting one end portion 226 of the outside spindle 22 into a hollow portion 242 of outside lever handle 24. Thereafter, the locking means and the first driving means are combined together by putting the locking plug 26 inside the outside spindle 22, wherein the locking slide 58 of the locking plug 26 slides along the pair of notches 56 of the outside spindle 22 to ends thereof.

The mounting means is assembled by passing the pair of mounting screw posts 142 through a pair of hexagonal holes 122 of the first mounting plate 12, wherein the spacer 16 locates inside a shaft hole 144 of the escutcheon 14 and outside of the boss 121 (see FIG. 8) of the first mounting plate 12. The mounting means and the first driving means are then assembled by inserting the outside spindle 22 into a shaft hole 123 of the mounting plate 12.

Finally, the driven means is added to the assembled portion of the outer portion of the lock assembly. First, the reverse plate 48 is fixed onto an arc-shape portion 124 of the first mounting plate 12 with a screw 483, such that ends 484 and 488 of the reverse plate 48 contact extrusions 126 and 127 of the arc-shape portion 124, respectively (a clearer expression shown in FIG. 10A). Thereafter, the spring 464, the square spindle 46, the spindle retainer ring 462, and the plunger bar 68 are assembled. The retractor spring 44 is then received into a hollow portion 125 of the mounting plate 12. Lastly, the retractor 42 is fastened to the square spindle 46 by a rectangular hole 426 thereof and the outside spindle 22 by fitting a pair of slots 424 thereof onto an end portion 225 of the outside spindle 22, thereafter being fixed by the spindle retainer 224.

Figure 3:
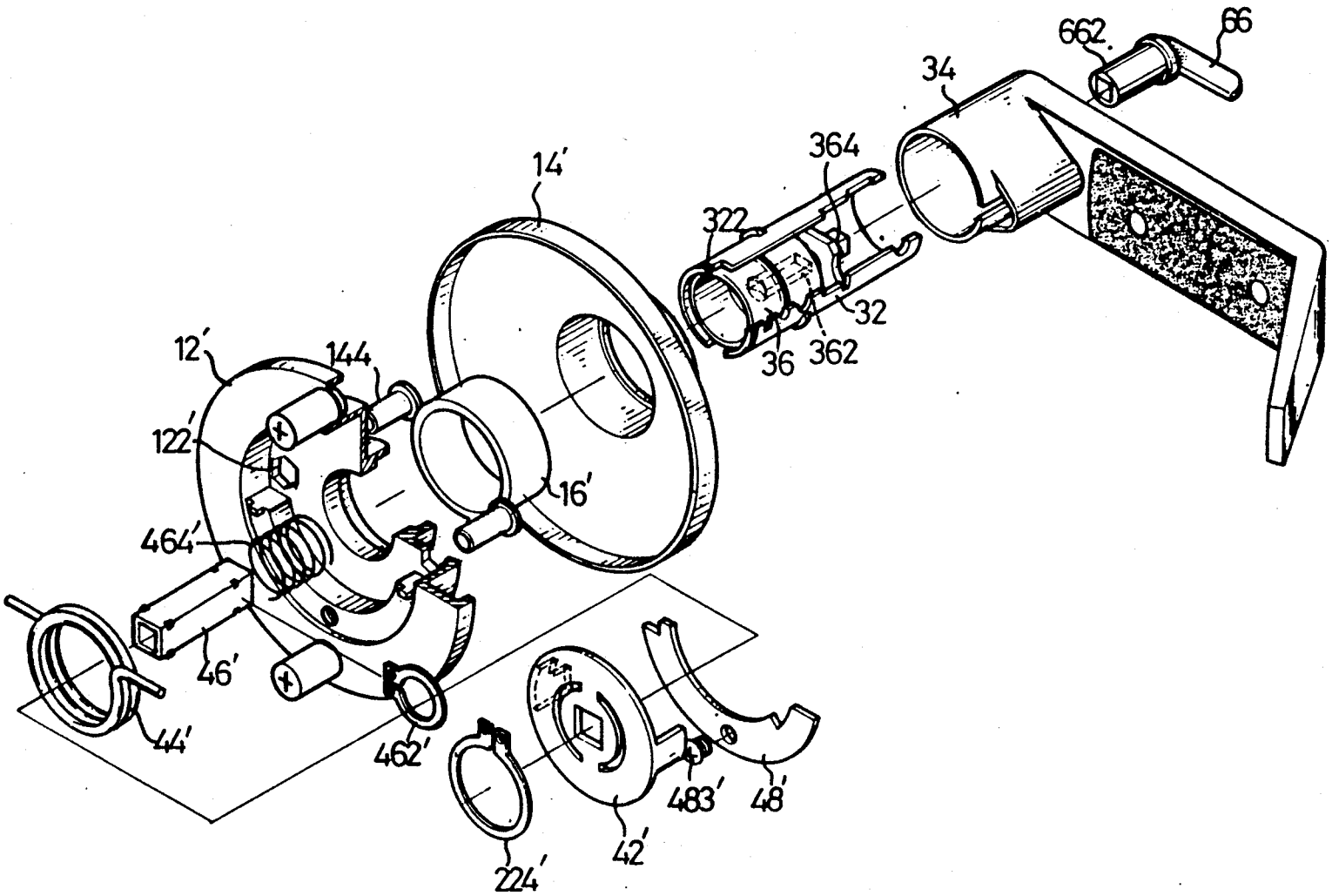
FIG. 3 is an exploded view of the inner portion of the lock assembly.

Referring to FIG. 3, the inner portion of the lock assembly comprises: a mounting means which includes an escutcheon 14', a spacer 16', and a mounting plate 12'; a second driving means which includes an inside lever handle 34, an inside spindle 32, and a turning sleeve 36; a driven means which includes a spring 464', a square spindle 46', a spindle retainer ring 462', a retractor spring 44', a reverse plate 48', a locking screw 483', a retractor 42', and a spindle retainer ring 224'; and a locking means which co-operates with the locking means of the outer portion of the assembly and includes a rectangular hole 362, which is engaged with the plunger bar 68 when the entire lock assembly is assembled together, formed by an inside portion of the turning sleeve 36, a rectangular bar 364, and a thumb turn 66 with a hole 662 to be fitted onto the rectangular bar 364. The assembling process of the inner door portion of the lock assembly is similar to that of the outer portion, requiring no further discussion.

Figure 4:
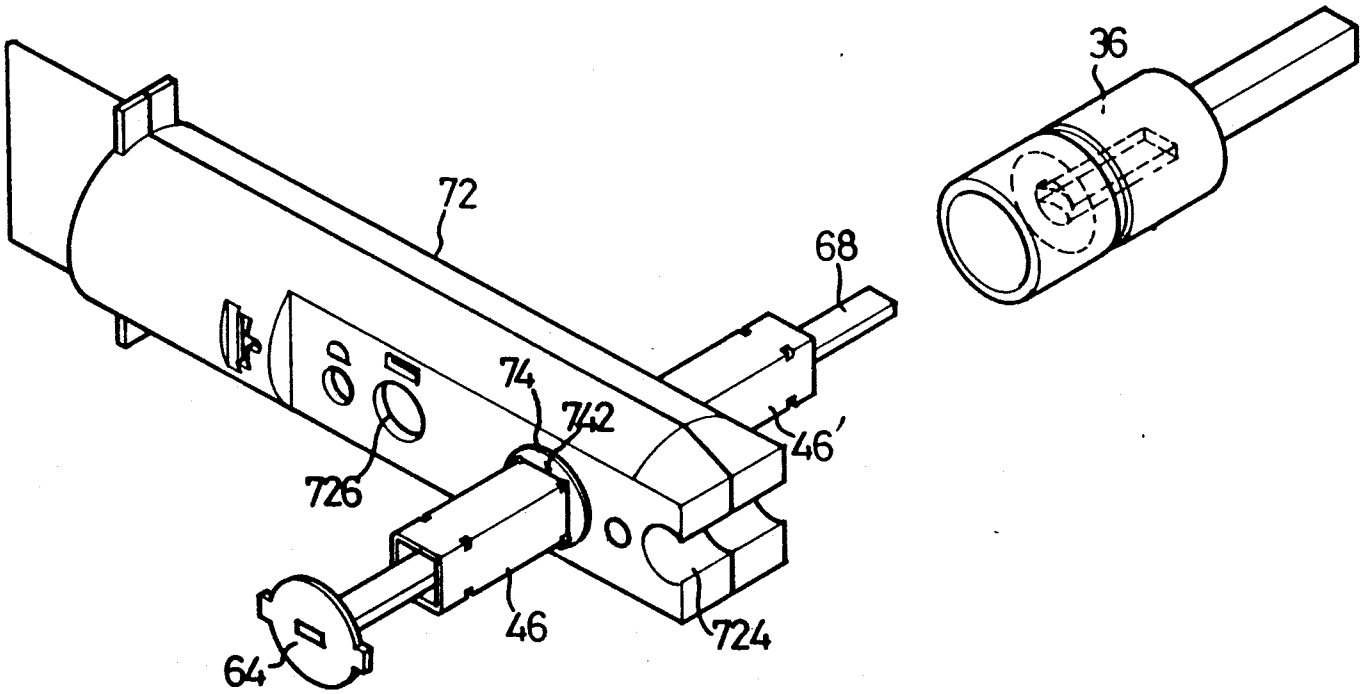
FIG. 4 is a perspective view of the latch assembly and a portion of the lock assembly.

Referring to the FIG. 4, the latch assembly is mounted onto a door (not shown). After the outer and inner portion of the lock assembly have been assembled, they can be mounted to the door, co-operating with the latch assembly. Firstly, the outer portion of the lock assembly is mounted onto the latch assembly, wherein the two mounting screw posts 142 (see FIG. 2) pass through two holes 726, 724 of a latch housing 72 with the square spindle 46 received within a rectangular hole 742 of a hub 74. Then, the inner portion of the lock assembly and the outer portion and the latch assembly are assembled together. Referring back to FIG. 3, the inner portion of the locking assembly comprises two mounting screws 144. As the inner portion is assembled with the outer portion, the two mounting screw posts 142 of the outer portion pass through two hexagonal holes 122' of the inner portion; the two portions of the lock assembly are mounted together by the engagement of the mounting screw posts 142 and the mounting screws 144. Also, as the inner portion of the lock assembly is mounted to the latch assembly, the square spindle 46' is received within a rectangular hole 745 of another hub 744 (see FIG. 5).

Figure 5:
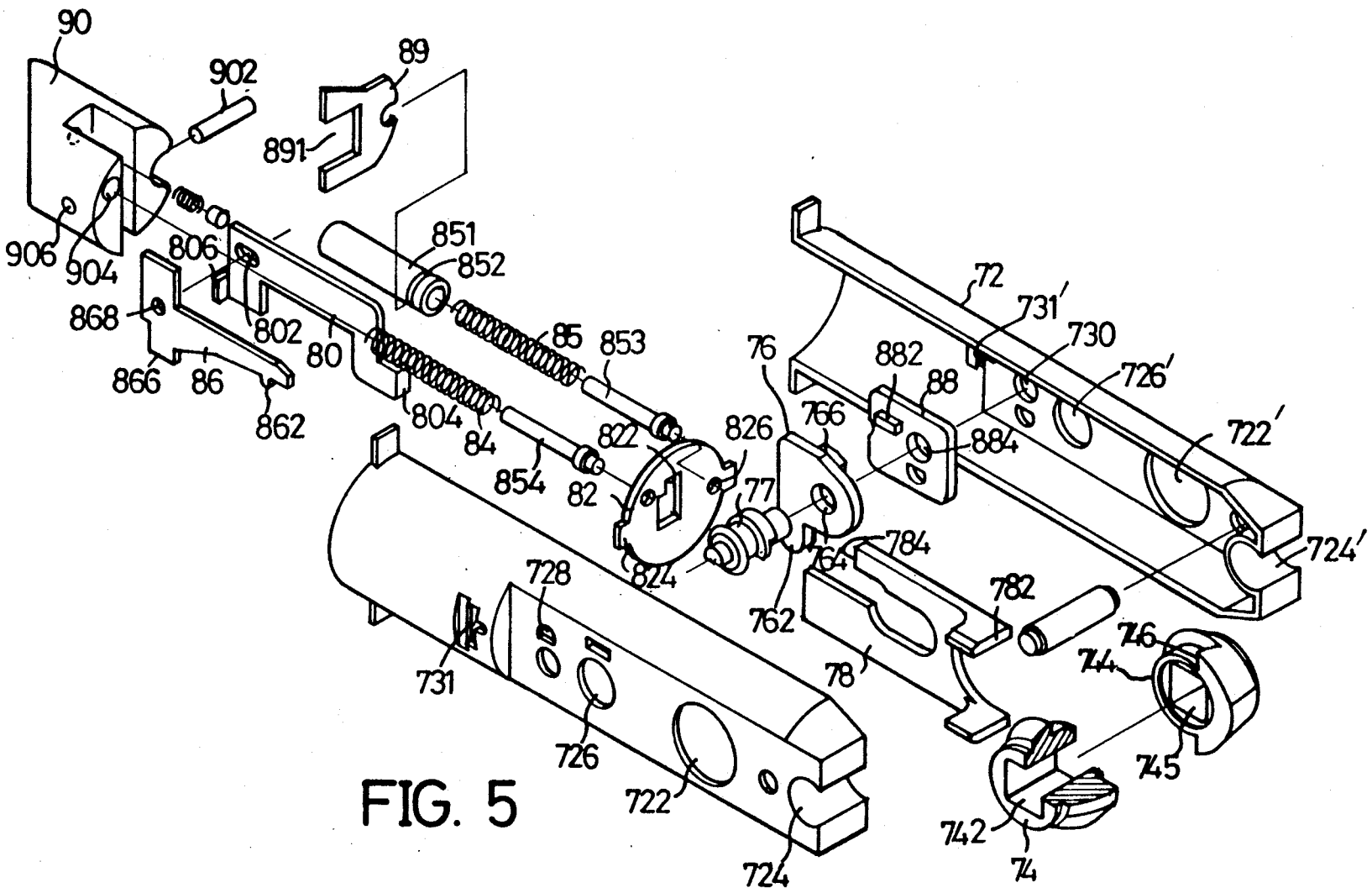
FIG. 5 is an exploded view of the latch assembly.

Referring to FIG. 5, the latch assembly comprises the latch housing 72, a pair of hubs 74, 744 rotatably mounted in two holes 722, 722' of the latch housing 72, a swivel 76 rotatably mounted to the latch housing by a cam 77, a retractor bar 78 mounted within the latch housing 72 for transmitting a rotating force of the hubs 74, 744 to the swivel 76, a latch bar 80 for transforming the rotating motion of the swivel 76 into a linear movement of a latch bolt 90, a spring means which comprises two spring 84, 85 for urging the bolt 90 with a returning spring force, a swivel spacer 88 fixedly secured to the latch housing 72 for blocking the swivel 76 as the swivel 76 rotates forward about 45 degrees from its original position, a bolt 90 secured to the latch bar 80 by a pin 902 passing through an elongate hole 802 of the latch bar 80 and a hole 906 of the bolt 90, a latch stop 86 mounted to the latch bar 80 and the bolt 90 by the same pin 902 for preventing improper operation of lock, and a retaining plate 82 with a hollow portion 822 for co-operating with the latch stop 86.

As one of the lever handles 24, 34 of the lock is rotated downward, i.e., counterclockwise (cf. FIG. 1), then the square spindles 46, 46' will drive a corresponding hub 74 or 744. The hub 744, for example, has an end face 746 on its periphery, which is connected with an end 782 of the retractor bar 78. As the hub 744 rotates, the end face 746 will push the end 782, causing the retractor bar 78 to move forward. The linear movement of the retractor bar 78 will cause a rotation, because one end 784 thereof, which is connected with a side extrusion 766, will push the side extrusion 766. Since the side extrusion 766 is distal to a rotating axis of the swivel 76, the pushing force of the retractor bar 78 will cause a counterclockwise rotation of the swivel 76.

The swivel 76 comprises a lug 762 which locates in a hollow portion formed by side extrusion 804 of an end of the latch bar 80 and also contacts an inner face of the side extrusion 804. As the swivel 76 rotates counterclockwise, the lug 762 thereof will pull the latch bar 80 backward, causing the bolt 90 to move backward and compress the two springs 84, 85 of the spring means. As the rotating force from the corresponding handle diminishes, the spring means will urge the bolt back to its original position.

Figure 6A:
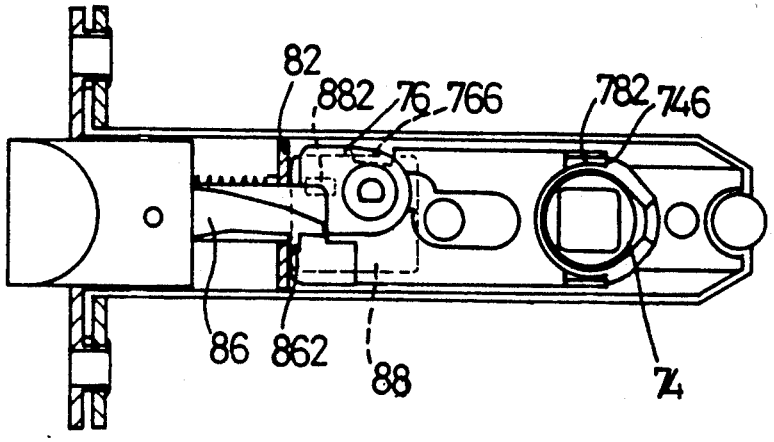
FIG. 6A is an assembled cross-sectional view of the latch assembly shown in a bolt thrown position.
Figure 6B:
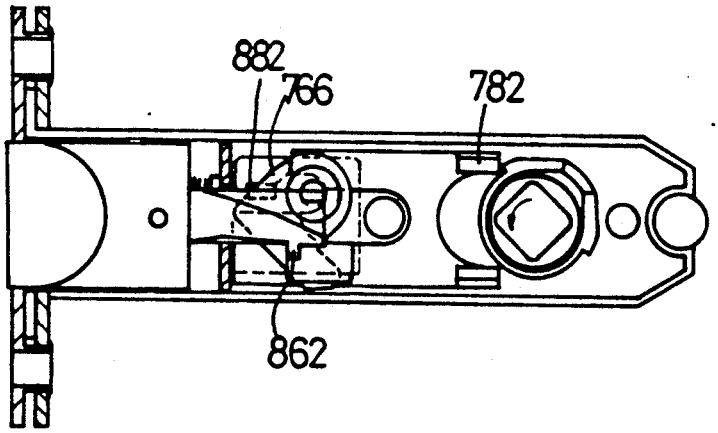
FIG. 6B is an assembled cross-sectional view of the latch assembly shown in a bolt withdrawn position.

FIG. 6A shows a position of the side extrusion 766 of the swivel 76 relative to a stopper 882 of the swivel spacer 88. When either of the lever handles 24 and 34 is rotated about 45 degrees, the side extrusion 766 of the swivel 76 will be blocked by the stopper 882 of the swivel spacer 88, as shown FIG. 6B. Thus, this mechanism makes the corresponding handle rotatable about 45 degrees to open the door.

Figure 7A:
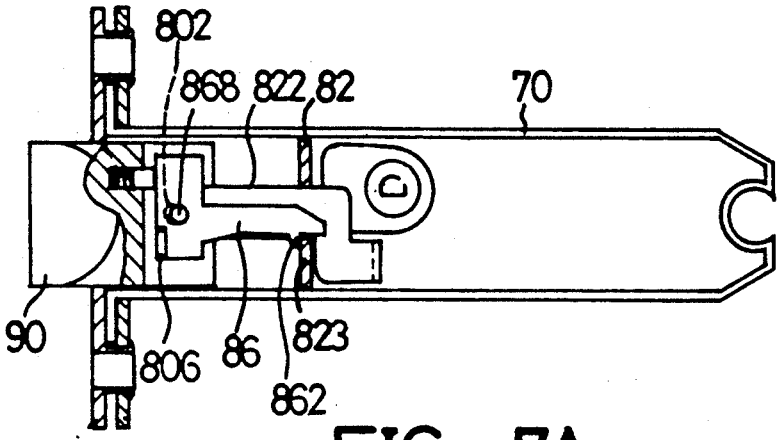
FIG. 7A is a cross-sectional view of the latch assembly, showing a latch stop thereof in a locked position.
Figure 7B:
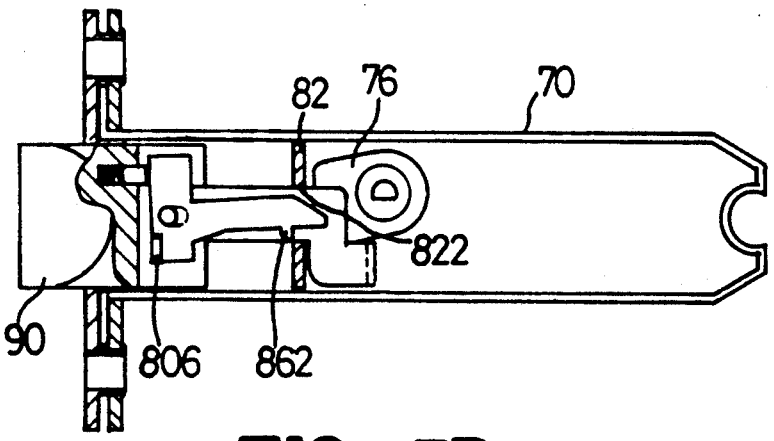
FIG. 7B is a view similar to FIG. 7A, showing the latch stop in an unlocked position.

FIG. 7A shows a position of the latch stop 86 relative to the retaining plate 82 before the latch assembly is actuated. In this condition, a catch 862 of the latch stop is blocked by a face portion 823 of the retaining plate 82. Because the bolt 90 is fixedly connected with the latch stop 86, the bolt 90 can not be pushed into the latch housing 72 in this situation. Referring to FIG. 7B, as the swivel 76 pulls the latch bar 80 backward, due to the elongate hole 802 of the latch bar 80, the latch bar 80 will have a linear movement before it drives the movement of the bolt 90. During the initial linear movement of the latch bar 80, a side extrusion 806 of the latch bar 80 will rotate the latch stop 86, and the catch 862 of the latch stop 86 will be lifted and pass through the hollow portion 822 of the retaining plate 82 to release the blockage between the catch 862 and the surface portion 823 of the retaining plate 82.

Figure 8:
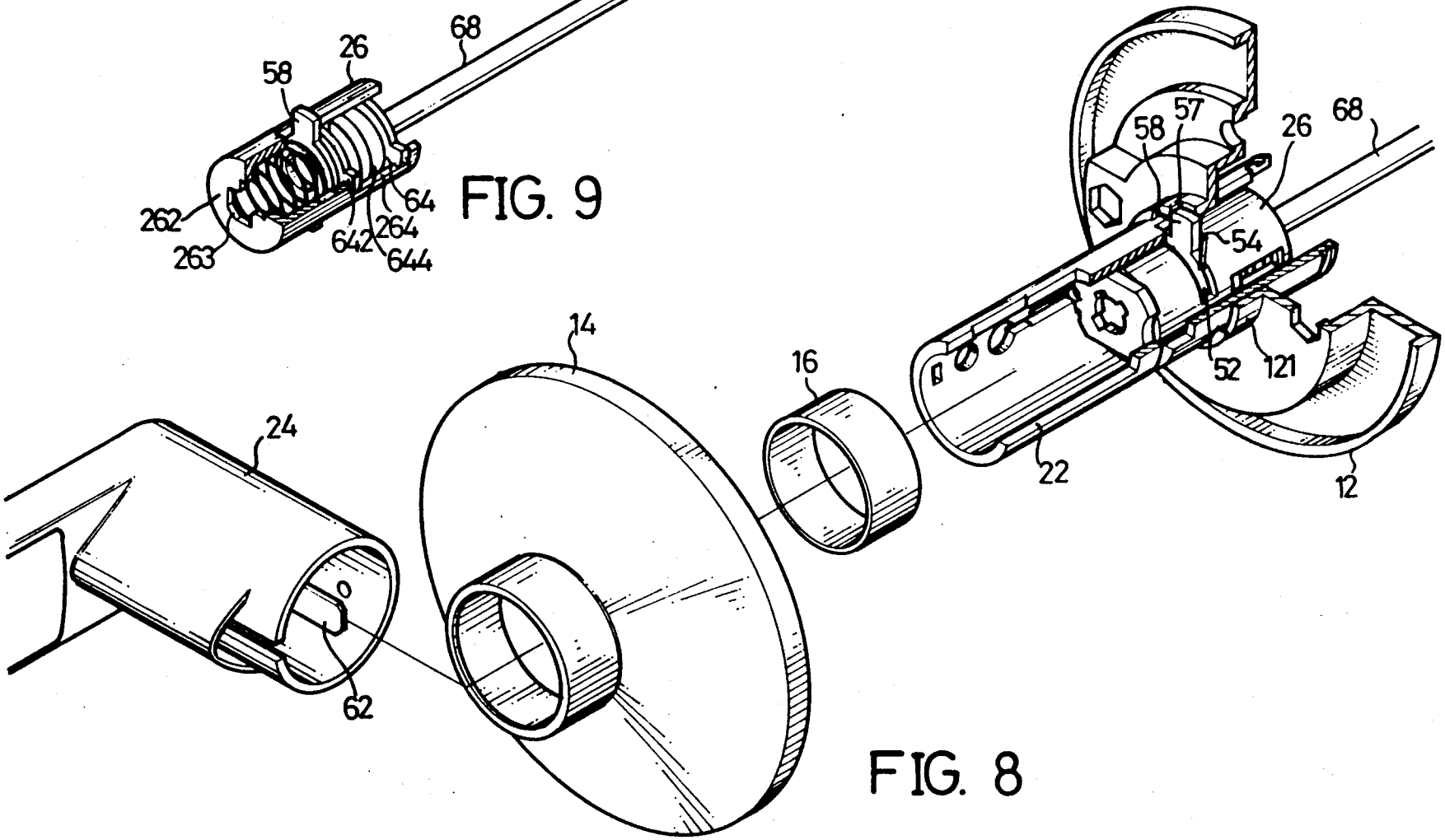
FIG. 8 is a cut-away perspective view of the outer portion of the lock assembly.
Figure 9:
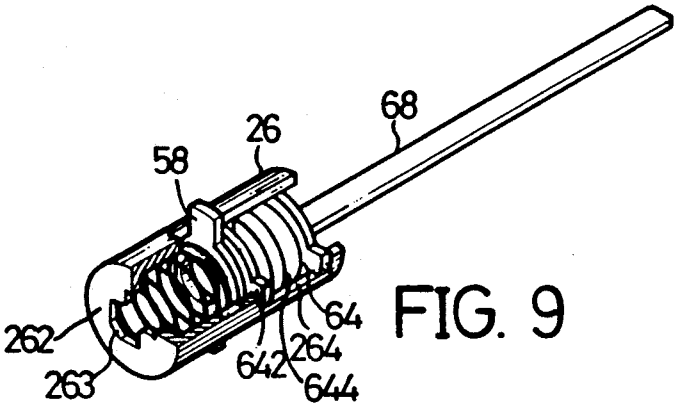
FIG. 9 is a cut-away perspective view of a portion of the lock assembly of FIG. 8.

Referring to FIG. 8 and FIG. 9, the mechanism for locking and unlocking the present invention is shown. When the lock is assembled, the cylinder bar 62 fits into a hole 263 located at an end 262 of the locking plug 26; thus, a rotation of the cylinder bar 62 by a key (not shown) will rotate the locking plug 26. Also, since the plunger bar 68 is connected with the plunger retainer 64, which is secured to the locking plug 26, as the plunger bar 68 rotates, the locking plug 26 also rotates. As the locking plug 26 is rotated by either of the cylinder bar 62 or the plunger bar 68, the locking slide 58 will have a linear motion within an annular slot 52. As the locking slide 58 is located on an indented side of the annular slot 52, the end portion of locking slide 58 will locate within the groove 57 of the boss 121 of the mounting plate 12. Thus, the outside spindle 22 can not be rotated by the corresponding handle, thereby locking the lock. As the locking slide 58 moves to another side of the slot by the rotation of the locking plug 26, the locking slide 58 will leave the groove 57; thus, the lock is released.

Figure 10A:
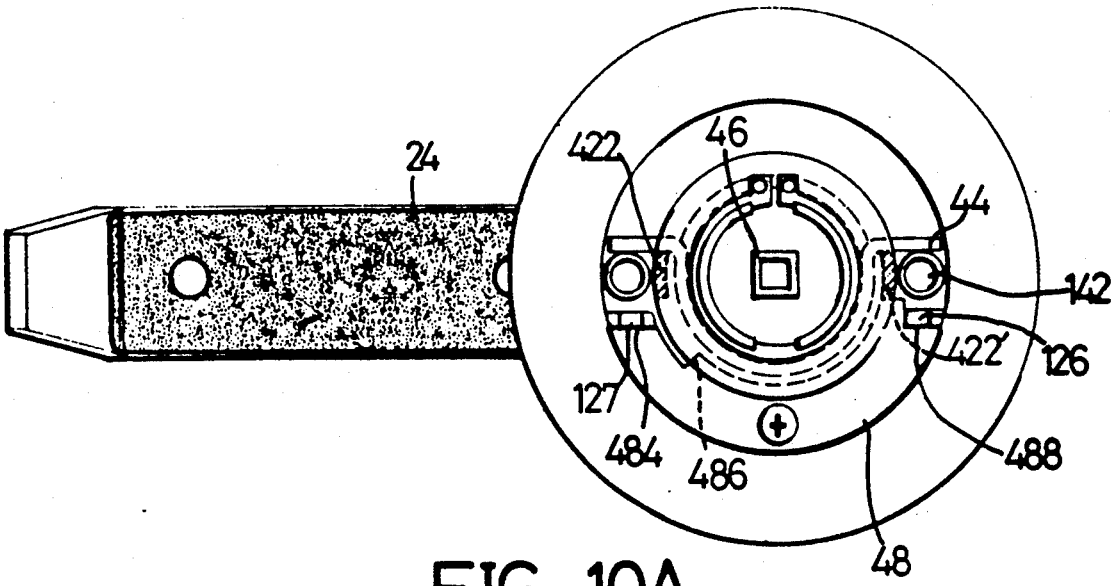
FIG. 10A and 10B are inner end view of the outer portion of the lock assembly showing the handle in an original position and a rotated position, respectively.
Figure 10B:
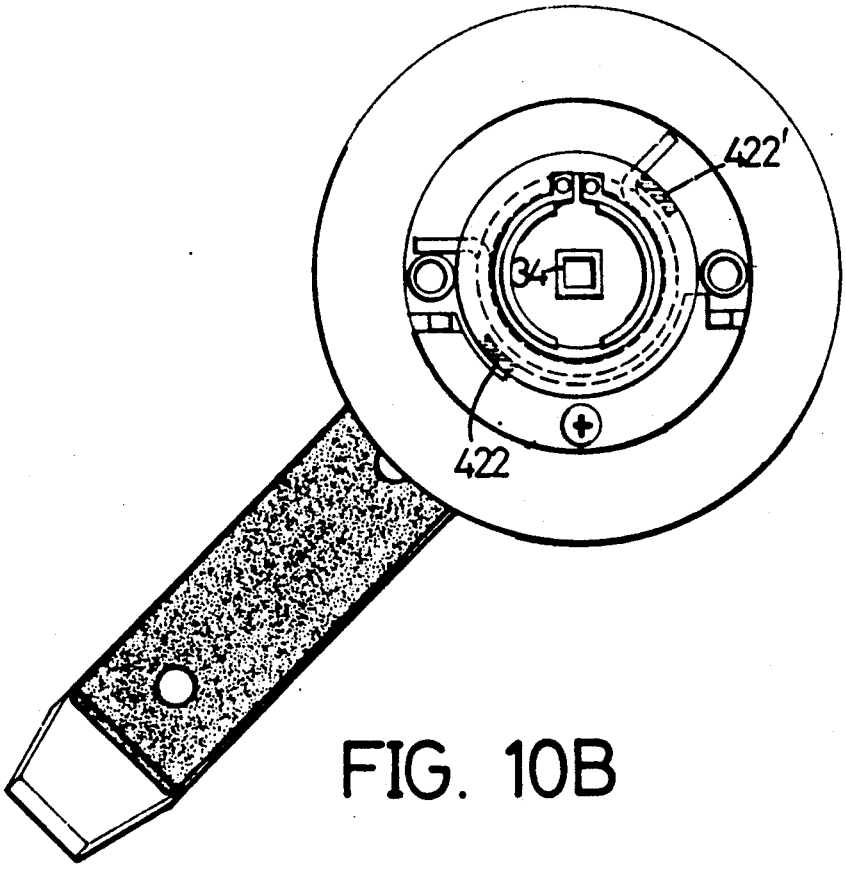
Figure 11A:
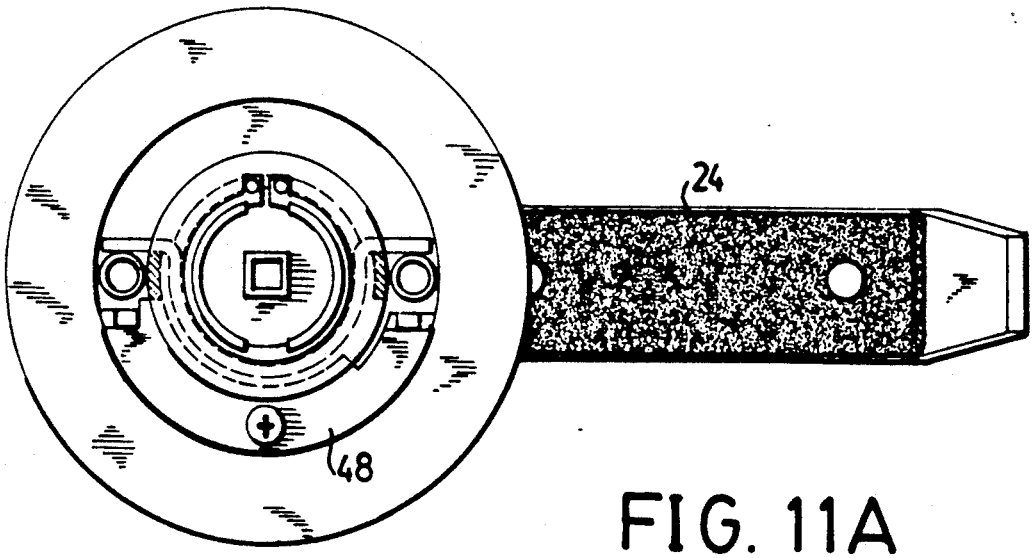
FIG. 11A and 11B are similar views to FIGS. 10A–10B, except that a reverse plate is left-right reversed and the handle is installed on a right hand door.
Figure 11B:
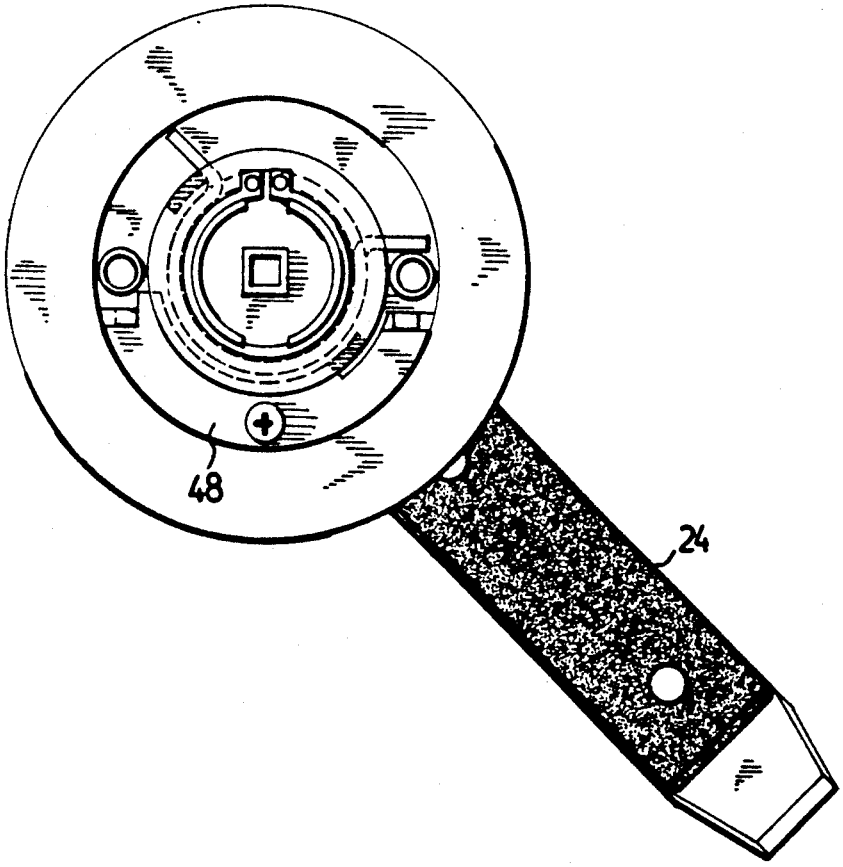

Referring to the FIGS. 10A and 10B, the former figure thereof shows the outer portion of the lock assembly, which is installed on a left hand door (not shown) before being rotated. As the handle rotates downward, as shown in FIG. 10B, one extrusion 422' of the retractor 42 will load a torque to the retractor spring. When the handle has been rotated down about 45 degrees, another extrusion 422 of the retractor 42 will be stopped by a cut 486 of the reverse plate 48. Referring to FIGS. 11A and 11B, as the reverse plate 48 is left-right reversed, the lock is to be installed on a right hand door. Of course, the inner portion of the lock assembly also must have the same adjustments for cooperation with the outer portion.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A lock assembly for cooperating with a latch assembly comprising:

a mounting means comprising a pair of escutcheons and a first and a second mounting plate mounted on a respective opposite sides of a door and fixedly attached to each other;

a first driving means rotatably mounted to said mounting means on an outer side of the door, said first driving means comprising an outside spindle adapted to be rotatable by an outside lever handle, a locking plug received within said outside spindle, and a control means for blocking a turning movement of said outside spindle relative to said mounting means, said control means comprising:

a pair of annular slots on said locking plug each having an indented edge;

a pair of notches diametrically formed on an end of said outside spindle near said first mounting plate;

a pair of grooves diametrically formed on a boss of said first mounting plate; and a locking slide diametrically positioned within and extending through said annular slots on said locking plug, said notches on said outside spindle, and said grooves on said first mounting plate, said locking slide permitting said locking plug to be rotatable with said outside spindle;

said locking slide being normally urged to bear against a first section of said indented edge to disengage from said grooves of said first mounting plate, and being linearly movable in an axial direction of said locking plug to engage with said first mounting plate in response to a turning movement of said locking plug;

a second driving means rotatably mounted to said mounting means on an inner side of the door, said second driving means comprising an inside spindle adapted to be rotatable by an inside lever handle and a turning sleeve;

a driven means provided at about a head of a corresponding spindle and substantially within an interior of a corresponding mounting plate facing the door, said driven means comprising:

a retractor fixedly secured to said head of said spindle and being rotatable therewith;

a retractor spring mounted in a stationary relationship to said mounting means, said retractor spring applying a returning spring force on said retractor as said retractor is turned with respect to said mounting means;

an square spindle mounted in a fixed relationship to said retractor and being turnable therewith; and a reverse plate fixedly attached to a corresponding mounting plate for controlling a predetermined direction of rotation of said retractor; and a locking means for manipulating said control means to releasably establish a blockage of said outside spindle relative to said mounting means.

2. The lock assembly according to claim 1, wherein:

said retractor comprises a pair of protruding wings; and said reverse plate comprises a first end for blocking a turning movement of said retractor relative to a corresponding mounting plate in a first direction and a second end for permitting a turning movement of said retractor relative to the corresponding mounting plate in a second direction which is opposite to said first direction.

3. The key assembly according to claim 2, wherein said second end of said reverse plate has a cut at a position where said retractor is turned 45 degrees to its original position for blocking a further turning movement of said retractor.

4. The lock assembly according to claim 1, wherein said locking means comprises a cylinder bar with one end adapted to be rotatable by a key from the outer side of the door, and with the other end fixedly secured to an end wall of said locking plug.

5. The key assembly according to claim 1, wherein said locking means comprises:

a plate received within said locking plug and being rotatable therewith;

a locking member rotatably mounted to said inside lever handle; and a plunger bar with one end rotatable by said locking member from the inner side of the door, and with the other end connected to said plate.

6. A lock comprising a lock assembly and a co-acting latch assembly, said lock assembly comprising:

a mounting means comprising a pair of escutcheons, a first and a second mounting plate mounted on a respective opposite sides of a door and fixedly attached to each other;

a first driving means rotatably mounted to said mounting means on an outer side of the door, said first driving means comprising an outside spindle adapted to be rotatable by an outside lever handle, a locking plug received within said outside spindle, and a control means for blocking a turning movement of said outside spindle relative to said mounting means;

a second driving means rotatably mounted to said mounting means on an inner side of the door, said second driving means comprising an inside spindle adapted to be rotatable by an inside lever handle and a turning sleeve;

a driven means provided at about a head of a corresponding spindle and substantially within an interior of a corresponding mounting plate facing the door, said driven means comprising:

a retractor fixedly secured to said head of said spindle and being rotatable therewith;

a retractor spring mounted in a stationary relationship to said mounting means, said retractor spring applying a returning spring force on said retractor as said retractor is turned with respect to said mounting means; and a reverse plate fixedly attached to a corresponding mounting plate for controlling a predetermined direction of rotation of said retractor;

a locking means for manipulating said control means to releasably establish a blockage of said outside spindle relative to said mounting means;

a square spindle mounted in a fixed relationship to said retractor and being turnable therewith; and said latch assembly comprising:

a latch housing fixedly mounted onto a door;

a pair of hubs rotatably mounted on said latch housing, each said driving cam having a shaft hole for receiving a corresponding square spindle;

a swivel rotatably supported within said latch housing and comprising a lug;

a retractor bar for turning said swivel in response to a turning movement of each hub;

a latch bar being movable in a longitudinal direction along said latch housing by said swivel, said latch bar comprising a first hook end linked to said lug of said swivel, an elongate hole for coupling to a bolt by a pin passing through said elongate hole, and a second hook end;

a retaining plate fixedly mounted within said latch housing and having a through hole;

a spring means disposed within said latch housing for urging latch bar and the coupled bolt against said retaining plate; and a latch stop pivoted to the bolt and being movable together therewith, said latch stop comprising an end portion normally being in contact with and blocked by said through hole of said retaining plate, said latch stop being pivoted about the bolt by said second hook end of said latch bar in response to a sliding movement of said latch bar without moving the bolt, thereby lifting said end portion and permitting a relative sliding movement between said latch stop and said retaining plate.

7. A lock assembly according to the claim 6, wherein said latch assembly further comprises a swivel spacer for blocking said swivel at an angular position where said latch bar is turned from its original position about 45 degrees.

* * * * *